US005601465A

United States Patent [19]

Fukuyo et al.

[11] Patent Number: 5,601,465

[45] Date of Patent: Feb. 11, 1997

[54] METHOD FOR MANUFACTURING ARC TUBE FOR DISCHARGE BULB

[75] Inventors: Takeshi Fukuyo; Shinichi Irisawa; Akihiro Nagata, all of Shizuoka, Japan

[73] Assignee: Koito Manufacturing Co., Ltd., Tokyo, Japan

[21] Appl. No.: 507,673

[22] Filed: Jul. 25, 1995

[30] Foreign Application Priority Data

Aug. 8, 1994 [JP] Japan ..... 6-185841

[51] Int. Cl.[6] ..... H01J 9/38

[52] U.S. Cl. ..... 445/6; 445/40

[58] Field of Search ..... 445/6, 40, 42

[56] References Cited

U.S. PATENT DOCUMENTS

| | | | |
|---|---|---|---|
| 2,353,783 | 7/1944 | Noel | 445/6 |
| 3,492,598 | 1/1970 | MacNair | 445/6 |
| 5,176,558 | 1/1993 | Newell | 445/6 X |

*Primary Examiner*—Kenneth J. Ramsey
*Attorney, Agent, or Firm*—Sughrue, Mion, Zinn, Macpeak & Seas

[57] ABSTRACT

A method for manufacturing an arc tube which obtains a high luminous flux retention rate by completely removing impurities, such as oxides, from the surfaces of the electrodes within the arc tube. An exhaust tube is connected to a glass tube of an arc tube in which a pair of electrodes are oppositely disposed. After gas is exhausted through the exhaust tube from the glass tube, inert gas is introduced. An arc discharge generating circuit is connected to the oppositely disposed electrodes, and an ion bombardment process is carried out in which an arc discharge is caused between the electrodes in the inert gas atmosphere at a current density of 30 to 100 A/mm$^2$. Due to the arc discharge process, impurities (oxides), which lead to a reduction of the luminous flux retention rate, are completely removed from the electrode surfaces. Gas is exhausted from the glass tube, and then a degassing process is carried out to degas the glass tube while it is heated to thus completely remove impurities from the inner wall of the glass tube. Metal halide as a luminous material, mercury, and a rare gas are successively introduced into the glass tube through the exhaust tube, and the exhaust tube is tipped off.

5 Claims, 11 Drawing Sheets

STANDARD SAMPLE

NO BOMBARDMENT PROCESS

FIG. 9

AMOUNT OF OXYGEN IN THE TEST SAMPLES

| CONDITION OF BOMBARDMENT PROCESS | AMOUNT OF OXYGEN (wt %) |
|---|---|
| NO BOMBARDMENT PROCESS | 0.74 |
| 400Torr, 1sec | 0.17 |
| 800Torr, 1sec | 0.17 |
| 1200Torr, 1sec | 0.06 |

FIG. 14

VARIATION OF OXYGEN AMOUNT IN LONGITUDINAL DIRECTION OF ELECTRODE

| CONDITION OF BOMBARDMENT PROCESS | ANALYSIS POSITION (μm) | | | | | | | | (UNITS: wt %) |
|---|---|---|---|---|---|---|---|---|---|
| | 150 | 300 | 450 | 600 | 750 | 900 | 1050 | 1200 | VALUE |
| NO BOMBARDMENT PROCESS | 3.39 | 6.02 | 4.92 | 5.26 | 6.21 | 4.45 | 3.59 | 3.15 | 4.62 |
| 400Torr, 1sec | 0.76 | 5.98 | 1.10 | 2.10 | 1.53 | 2.20 | 8.22 | 8.17 | 3.76 |
| 800Torr, 1sec | 0.57 | 0.86 | 0.81 | 0.67 | 1.39 | 0.57 | 4.30 | 8.51 | 2.21 |
| 1200Torr, 1sec | 1.10 | 0.86 | 1.20 | 1.29 | 9.63 | 7.36 | 1.53 | 1.63 | 3.08 |

METHOD FOR MANUFACTURING ARC TUBE FOR DISCHARGE BULB

BACKGROUND OF THE INVENTION

The present invention relates to a method for manufacturing an arc tube used as a light source for a metal halide lamp employed as a discharge bulb for a motor vehicle headlamp or the like.

A discharge bulb for a motor vehicle headlamp or the like includes an arc tube composed of a glass tube containing mercury or metal halide as a luminous material, and a rare gas. The discharge bulb is superior to a bulb of the filament type in that the former is free from failure caused by filament burnout, and has the benefit of a large amount of light emitted. For this reason, the discharge bulb has been given a great amount of attention recently.

As shown in FIG. 19, an arc tube 1 is composed of a glass tube 1*a* pinch sealed at both ends thereof. Metal halide (scandium iodide ($ScI_3$), sodium iodide (NaI), and the like) as a luminous material, mercury and rare gas (Xe, Ar or the like) is contained in the central portion of the glass tube. A lead wire a, a molybdenum foil b, and an electrode (bar) c are assembled into a single unit (electrode assembly). The electrode assemblies are respectively attached to the pinch sealed portions 1*b* in a sealed fashion, as shown. A pair of electrodes (bars) c are disposed opposite one another within the glass tube 1*a*.

To manufacture the arc tube 1, a T-shaped glass tube W as shown in FIG. 20 is first provided, in which a exhaust tube 2 is connected to the glass tube 1*a* of the arc tube 1. A degassing process to remove impurities from the glass tube 1*a* is carried out. In the degassing process, the glass tube 1*a* is degassed by heating the tube without connecting an exhaust device (not shown) through a connection head 10 to the exhaust tube 2. Subsequently, an ion bombardment process is carried out. For this process, inert gas is introduced into the glass tube l*a* through the exhaust tube 2. The electrodes thereof are connected to a glow discharge generating circuit 6. Current is fed to the electrodes to thereby cause a discharge between the electrodes. As a result, impurities adhering to the surface of the electrodes c are gasified and discharged therefrom. Thereafter, metal halide (scandium iodide ($ScI_3$), sodium iodide (NaI), and the like), mercury, and a rare gas (Xe, Ar or the like) are successively introduced into the glass tube 1*a*. Then, the exhaust tube 2 is tipped off.

The glow discharging circuit 6 is constructed such that the electrodes of the arc tube are connected to the secondary coil of a booster transformer T1 through a current limiting coil L1. The primary coil of the booster transformer T1 is connected to an AC power source (e.g., 200 V) through a switch SW1.

The ion bombardment process that is carried out before the introduction of metal halide (scandium iodide ($ScI_3$), sodium iodide (NaI), and the like), mercury, and rare gas, is effective in removing impurities (mainly oxide) adhering to the electrodes and improving the luminous flux retention rate. For this reason, the ion bombardment process is indispensable for the arc tube manufacturing process.

When an impurity (oxygen) is present in the glass tube 1*a*, $ScI_3$ is chemically transformed, as indicated by the following equation:

$$4ScI_3+4SiO2_2+3O_2+6Hg \rightarrow 2Sc_2Si_2O_7+6HgI_2$$

From this, it may be presumed that the luminous flux is reduced when oxygen is present as an impurity. To control the reduction of the luminous flux, it is desirable to remove the impurities (particularly oxygen) from the inside of the glass tube 1*a* before the introduction of metal halide (scandium iodide ($ScI_3$), sodium iodide (NaI), and the like), mercury, and a rare gas.

In the conventional ion bombardment process, current of a relatively low current density (several mA/mm$^2$ to several tens mA/mm$^2$) is fed to the electrodes c by the glow discharge generating circuit 6. Accordingly, the discharge caused between the electrodes c is a glow discharge. The glow discharge is not capable of sufficiently removing the impurities from the electrode surfaces and providing a satisfactorily high luminous flux retention rate.

In the conventional arc tube manufacturing method, the ion bombardment process follows the degassing process. Accordingly, there is the possibility that oxide material scattered from the electrode surfaces during the glow discharge in the ion bombardment process will adhere to the wall of the glass tube 1*a*, and thus oxide material is left on the tube wall after the ion bombardment process.

SUMMARY OF THE INVENTION

For the above reasons, an object of the present invention is to provide a method for manufacturing an arc tube which can secure a high luminous flux retention rate by surely removing impurities, such as oxides, from the surfaces of the electrodes within the glass tube.

To achieve the above and other objects of the invention, there is provided a method for manufacturing an arc tube for a discharge bulb in which an exhaust tube is connected to a glass tube of an arc tube in which a pair of electrodes are oppositely disposed. An exhaust device is connected to the exhaust tube, and gas contained in the glass tube is exhausted thereby. After gas is exhausted through the exhaust tube from the glass tube, inert gas is introduced into the glass tube. An arc discharge generating circuit is connected to the oppositely disposed electrodes, and an ion bombardment process is carried out in which an arc discharge is caused between the electrodes in the inert gas atmosphere. Gas is then exhausted from the glass tube, and a degassing process is carried out which degasses the glass tube while heating the glass tube. Metal halide as a luminous material, mercury, and a rare gas are successively introduced into the glass tube through the exhaust tube, and the exhaust tube is tipped off. The method of the invention is particularly characterized in that, in the ion bombardment process, the current density of the current applied to the electrodes is set at 30 to 100 A/mm$^2$, which causes an arc discharge between the electrodes.

In the inventive arc tube manufacturing method, the current application time of the current fed to the electrodes in the ion bombardment process is within the range of 0.5 to 1 second.

Furthermore, the inert gas introduced into the glass tube in the ion bombardment process is preferably argon gas, and the gas pressure in the glass tube is within the range of 800 to 1200 Torr.

In the ion bombardment process, the current density of the current fed to the electrodes is 30 to 100 A/mm$^2$. This range of values is considerably higher than the current density (several of mA/mm$^2$ to several tens of mA/mm$^2$) of the current fed to the electrodes in the conventional ion bombardment process. Accordingly, an arc discharge, which creates a higher temperature than the temperature created by a glow discharge, takes place between the electrodes. Due to the arc discharge, any impurities (mainly oxides) adhering to the electrode surfaces are surely gasified and the gasified impurities are exhausted from the exhaust tube. As a result, oxides and the like adhering to the electrode surfaces are surely removed therefrom.

Part of the impurities scattered from the electrode surfaces when the arc discharge takes place in the ion bombardment process may adhere to the wall of the glass tube. These impurities may be left on the wall of the glass tube. However, any such impurities are surely removed by the degassing process which follows the ion bombardment process, in the degassing process, the glass tube is degassed while being heated.

If the current application time of the current fed to the electrodes is shorter than 0.5 second, the arc discharge time is so short that the removal of oxides from the electrodes unsatisfactory. If the current application time exceeds 1 second, the arc discharge time is so long that the electrodes are excessively heated to the point where they are possibly deformed.

Argon gas is inexpensive and easy to handle. As the gas pressure in the glass tube is higher, thorough removal of oxides from the spherical parts of the electrodes is ensured. To remove oxides from the spherical parts of the electrodes, the gas pressure is preferably set within the range of 800 to 1200 Torr.

BRIEF DESCRIPTION OF THE DRAWINGS

FIG. 9 is a table showing the quantities of oxygen determined by the intensities of the analysis peaks of test samples to the analysis peak of a standard sample;

FIG. 14 is a table showing the quantities of oxygen determined by the intensities of the analysis peaks of test samples to the intensity (plotted on the scale) of the analysis peak of a standard sample (measured every 150 μm from the boundary of the electrode shaft part and the spherical part);

FIG. 15(*b*) is a graph showing tube voltage characteristics of arc tubes (subjected to an ion bombardment process by arc discharge) manufactured using the method of the invention;

FIG. 16(*b*) is a graph showing luminous flux retention rate characteristics of arc tubes (subjected to an ion bombardment process by arc discharge) manufactured using the conventional method;

FIG. 17(*b*) is a graph showing color temperature characteristics of arc tubes (subjected to an ion bombardment process by arc discharge) manufactured using the conventional method;

FIG. 18(*b*) is a graph showing color rendering index (Ra) characteristics of arc tubes (subjected to an ion bombardment process by arc discharge) manufactured using the conventional method;

DESCRIPTION OF THE PREFERRED EMBODIMENTS

Preferred embodiment of the present invention now will be described with reference to the accompanying drawings.

Figure 1:
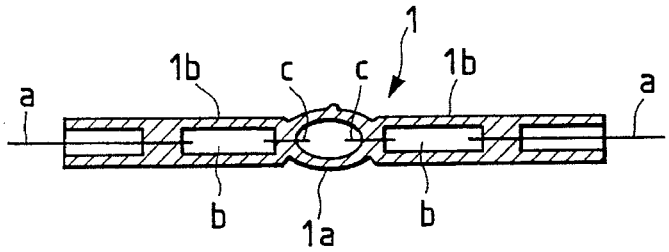
FIG. 1 is a longitudinal sectional view showing an arc tube manufactured by a method according to a preferred embodiment of the present invention.
Figure 2:
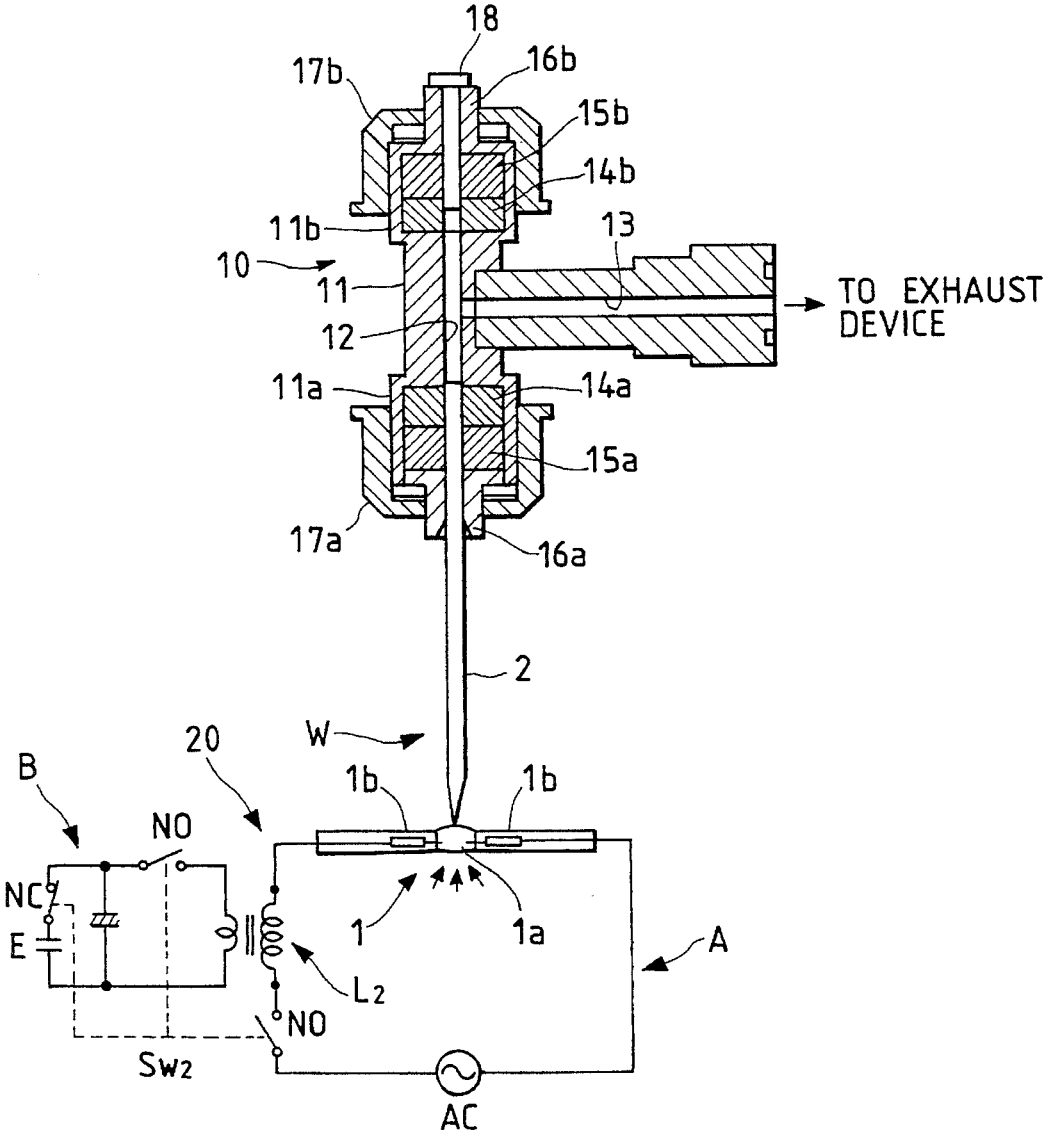
FIG. 2 is a diagram for explaining the arc tube manufacturing method of the present invention.

FIG. 1 is a longitudinal sectional view showing an arc tube manufactured using a method according to a preferred embodiment of the present invention. FIG. 2 is a diagram for explaining the arc tube manufacturing method of the present invention.

In these figures, reference numeral 1 designates an arc tube for a discharge bulb. The construction of the arc tube 1 is generally the same as the conventional arc tube shown in FIG. 19. Therefore, like reference numerals are used for designating like portions in FIG. 19 for simplicity.

Figure 19:
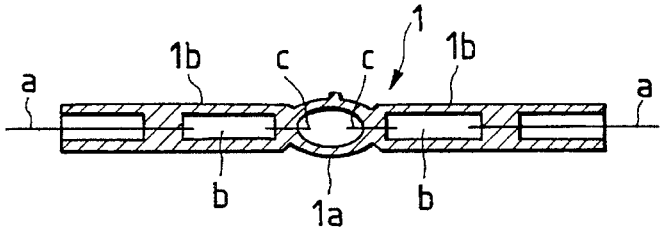
FIG. 19 PRIOR ART
FIG. 19 is a longitudinal sectional view showing a conventional arc tube.
Figure 20:
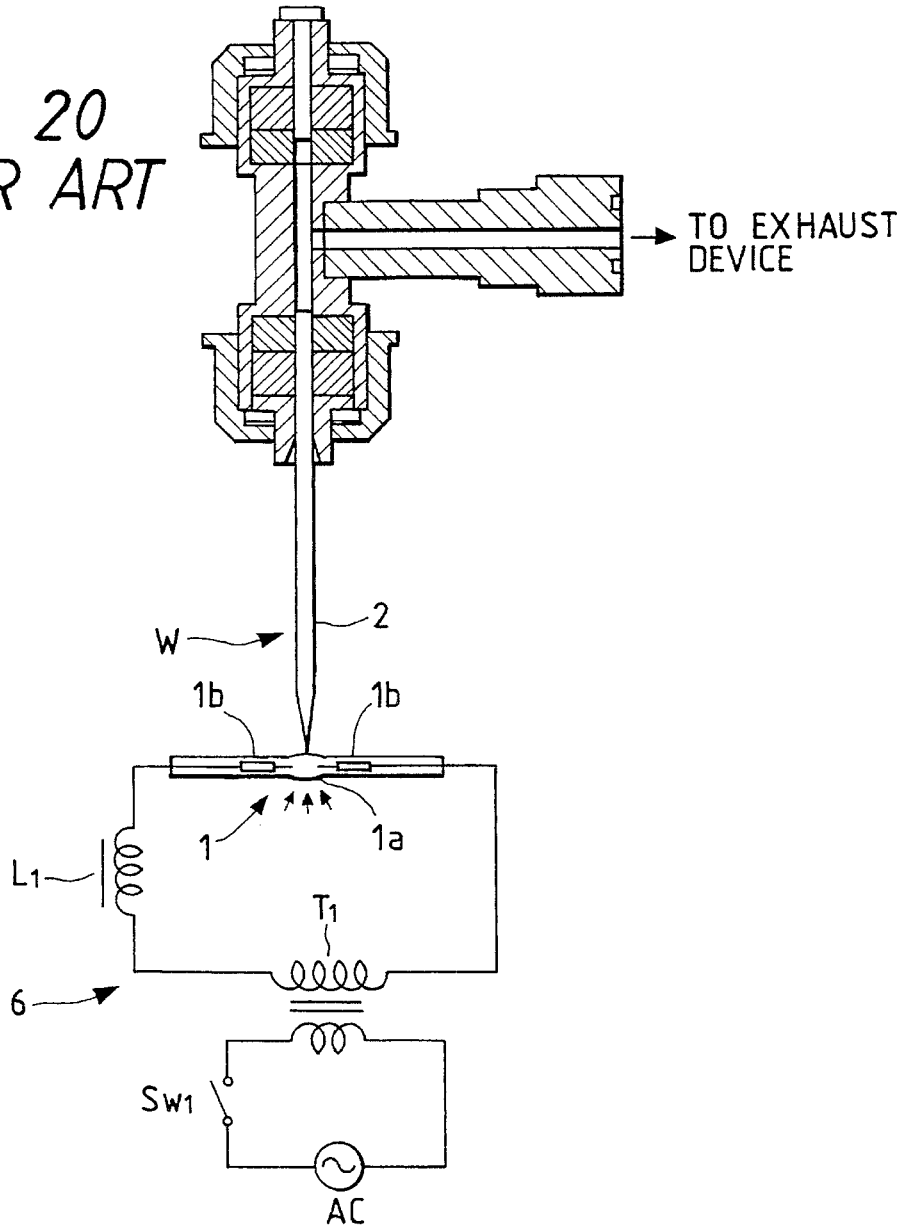
FIG. 20 PRIOR ART
FIG. 20 is a diagram showing a conventional method for manufacturing an arc tube.

The quantities of impurities (impurities other than metal halide, mercury, and intentionally introduced rare gas) within the glass tube 1*a* of the arc tube are smaller than those in the conventional arc tube of FIG. 19.

Each electrode c is worked with a laser device to obtain a spherically shaped tip. The electrode c thus shaped, molybdenum foils b and lead wires a are united into an electrode assembly. The electrode assembly thus formed and the arc tube are pinch sealed. When the electrodes are worked with a laser, the surfaces of the electrodes are oxidized.

Before the electrodes and the arc tube are pinch sealed, the electrodes are placed in a vacuum at 2000° C. to thereby remove oxide from the electrode surfaces.

After the electrode assemblies and the arc tube are pinch sealed, the resultant structure is subjected to an ion bombardment process under conditions which are different from those of the conventional ion bombardment process. With the inventive ion bombardment process, the impurities within the glass tube 1*a*, such as oxides adhering to the surfaces of the electrodes c, are surely removed. Following this, metal halide, sodium iodide, mercury, and rare gas are successively introduced into the glass tube 1*a*.

The conditions for the ion bombardment process are: argon gas is introduced into the glass tube 1*a* under a pressure in the range of 200 to 1200 Torr, and current of which the current density is 30 to 100 A/mm$^2$ is applied to the electrodes c. Under these conditions, an arc discharge is caused to take place between the electrodes for 0.5 to 1 second. If the current density is equal to or smaller than 30 A/mm$^2$, no arc discharge takes place between the electrodes, so that the oxide is insufficiently removed from the electrode surfaces. On the other hand, if the current density is equal to or larger than 100 A/mm$^2$, the electrodes are excessively heated to the extent that they may be deformed. For this reason, the current density of the current applied to the electrodes is preferably within the range of 30 to 100 A/mm$^2$.

If the duration of the arc discharge exceeds one (1) second, certain defects are caused, namely, the electrodes are deformed or the wall of the glass tube 1*a* is blackened. It is speculated that these defects are due to the scattering of tungsten of the electrodes c. In this respect, it is preferable to set the current application time (discharge time) at no more than 1 second. On the other hand, if the current application time is shorter than 0.5 second, the oxide is insufficiently removed. As a consequence, 0.5 to 1 second is preferable for the duration of current application to the electrodes, i.e., the duration of the arc discharge between the electrodes.

In FIG. 2, an exhaust tube 2 is connected to the glass tube 1*a* of the arc tube 1 so as to communicate therewith, to thereby form a T-shaped glass tube W.

Reference numeral 10 designates a discharge-tube connection head for connecting an exhaust device to the exhaust tube 2 of the arc tube 1. The discharge-tube connection head 10 contains therein a T-shaped path composed of a vertical path 12 and a horizontal path 13 horizontally extending from the mid point of the vertical path 12.

A chuck mechanism is firmly attached to each of the top and the bottom end, both being opened, of the vertical path 12. The chuck mechanism includes a base 14*a*, a cylindrical rubber bushing 15*a*, a cylindrical member 16*a* with a collar, which are contained in a cylindrical portion 11*a* of a head body 11, and a fastening nut 17*a* which is screwed to the male screw part of the cylindrical portion 11*a* and holds the cylindrical member 16*a*.

When the exhaust tube 2 of the T-shaped glass tube W is inserted into the insertion hole of the bushing 15*a* and the fastening nut 17*a* is turned, the bushing 15*a* is axially compressed while being radially expanded, to thereby secure airtightness between the vertical path 12 and the exhaust tube 2.

Reference numeral 18 designates a blank plug for closing the opening of the top end of the vertical path 12 when it is set to the top of the vertical path 12.

An arc discharge generating circuit 20 is provided for causing an arc discharge between the oppositely disposed electrodes c, the circuit 20 including a discharge maintaining circuit A and a trigger circuit B for triggering the discharge. The discharge maintaining circuit A includes a current limiting coil L2 of which the secondary coil is connected at one end to one of the electrodes, a switch SW2 of which the normally open contact is connected at one end to the other end of the secondary coil of the current limiting coil L2, and an AC power source AC connected between the other end of the switch SW2 and the other electrode. The AC power source AC supplies an AC voltage of, for example, 200 V. The waveform of the AC voltage may be sinusoidal or rectangular.

The trigger circuit B includes a capacitor C connected across a series circuit of a normally open contact of the switch SW2 and the primary coil of the current limiting coil L2, and a DC power source E connected across a series circuit of a normally closed contact of the switch SW2 and the capacitor C. In the trigger circuit B, the capacitor C is charged in advance by the DC power source E.

In the arc discharge generating circuit 20 thus constructed, when the switch SW2 is turned on, the voltage from the AC power source AC is applied between the paired electrodes, and a voltage from the trigger circuit B is also applied to the electrodes, through the current limiting coil L2.

The voltage of the trigger circuit B is generated for a considerably short period of time when the capacitor C is discharged through the current limiting coil L2. At the time the superposed voltage is applied to the electrode pair, the current density of the current applied to and flowing through the electrodes is considerably large in the initial stage. As a result, an arc discharge takes place between the electrodes. The arc discharge thus generated is maintained by the voltage supply from the AC power source AC.

A method for manufacturing the arc tube shown in FIG. 1 will be described.

An exhaust device (not shown) is connected to the exhaust tube 2 of the arc tube 1 through the discharge-tube connection head 10 shown in FIG. 2. After gas is exhausted from the glass tube 1*a* by the exhaust device, argon gas is introduced into the glass tube 1*a*, with the gas pressure in the glass tube 1*a* be maintained at 800 to 1200 Torr. The arc discharge generating circuit 20 applies current (at a density of 30 to 100 A/mm$^2$) to the electrode pair c, causing an arc discharge between the electrodes. Due to the arc discharge, oxide adhering to the electrode surfaces is gasified, and the resultant oxide gas is exhausted from the glass tube 1*a* through the exhaust tube 2. In this manner, the ion bombardment process is carried out to thereby remove the impurities from the electrodes c.

Following the ion bombardment process, a degassing process is carried out in which the glass tube 1*a* is degassed while it is heated at 1100° C., to thereby completely remove the impurities adhering to the wall of the glass tube 1*a*.

Argon gas is introduced into the glass tube 1*a*, and then pellets of metal halide ($ScI_3$, NaI or the like) are inserted into the tube. Then, the opening of the top end of the vertical path 12 is closed with the blank plug 18. The glass tube 1*a* is heated at a temperature high enough to sufficiently melt the metal halide, i.e., 400° to 800° C. In this way, a process of baking the metal halide is carried out.

Subsequently, the top end of the vertical path 12 is opened, and mercury particles are inserted into the glass tube 1*a* while inert gas (Ar gas) is supplied through the horizontal path 13 into the glass tube la. Afterwards, the top end of the vertical path 12 is closed with the blank plug 18, and inert gas (Xe gas) is supplied through the horizontal path 13 to the glass tube 1*a*.

The exhaust tube 2 is primarily tipped off at a position above the glass tube 1*a* while cooling the space around the glass tube 1*a* with liquid nitrogen. The exhaust tube 2 secondarily tipped off at a position near the glass tube 1*a* to thereby seal mercury and metal halide, together with Xe gas, in the glass tube 1*a*.

In the conventional arc tube manufacturing method, a degassing process, which degasses the glass tube 1*a* while heating the same, is carried out before the ion bombardment process. On the other hand, in accordance with the invention, a degassing process is carried out after the ion bombardment process. Therefore, impurities within the glass tube, such as impurities adhering to the electrodes and the tube wall, can completely be removed. Indeed, oxide attached to the electrodes can be removed by the arc discharge in the ion bombardment process.

However, there is a possibility that oxide scattered from the electrode surfaces when the arc discharge progresses may remain on the wall of the glass tube. Use of only the ion bombardment process is unsatisfactory in removing all impurities from the tube wall. It is noted here though that in the arc tube manufacturing method of the present invention, the degassing process, which follows the ion bombardment process, removes the remaining impurities from the wall of the glass tube. Therefore, with the invention all impurities are removed from the glass tube.

The degassing process employed in the invention is the same as that in the conventional method. Also, the process to introduce metal halide, mercury and Xe gas into the glass tube is the same as in the conventional method. Hence, only processes different from those in the conventional practice will be described, while for the remaining processes, reference is made to the description thereof already given.

The conditions for the ion bombardment process will be more specifically described.

An ion bombardment process was carried out in the following manner. Three types of arc tubes (referred to as test samples) containing gas at 400, 800, and 1200 Torr were used. Current at 80 A/mm$^2$ in current density was applied to the electrodes of these tubes for one second. Under this condition, an arc discharge was caused between the electrodes. Then, each of the tubes was degassed. These test samples were tested for point analysis and line analysis. For the tests, an electronic microanalyzer (Shimazu Model EPMA-8705) was used. The resultant point analysis data were as shown in FIGS. 4 to 9, and the resultant line analysis data were as shown in FIGS. 10 to 14.

Figure 3:
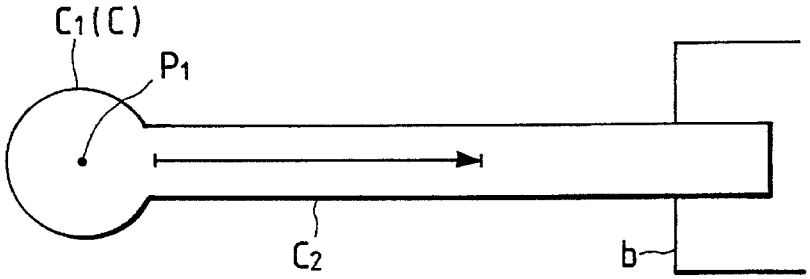
FIG. 3 is a diagram showing a point analysis position and a line analysis position on the electrode.

As shown in FIG. 3, the point analysis was carried out on oxygen at a position $P_1$ near the center of the spherical part $C_1$ of the electrode. The line analysis was carried out on oxygen over the axial length measured from the boundary between an electrode shaft part $C_2$ and the spherical part $C_1$.

Figure 4:
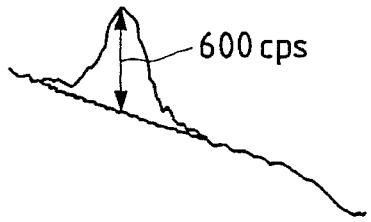
FIG. 4 is a graph showing point analysis data of a standard sample (spherical part of the electrode)
Figure 5:
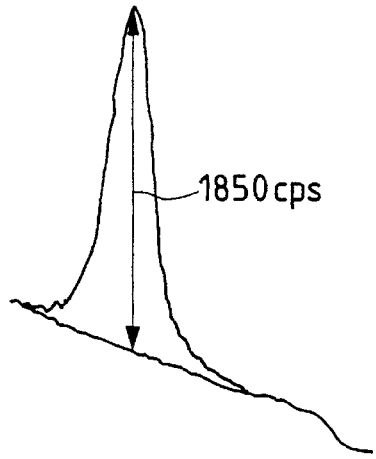
FIG. 5 is a graph showing point analysis data of a sample (spherical part) not subjected to the ion bombardment process.
Figure 6:
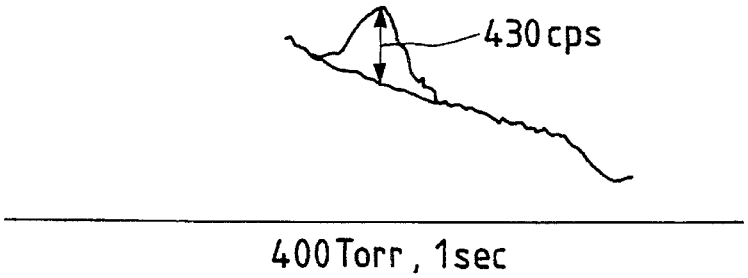
FIG. 6 is a graph showing point analysis data of a sample (spherical part) subjected to the ion bombardment process for one second at 400 Torr.
Figure 7:
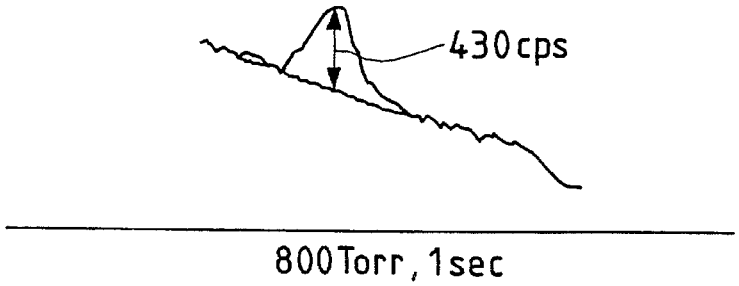
FIG. 7 is a graph showing point analysis data of a sample (spherical part) subjected to the ion bombardment process for one second at 800 Torr.
Figure 8:
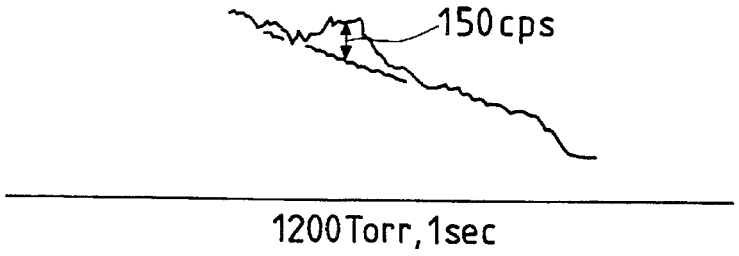
FIG. 8 is a graph showing point analysis data of a sample (spherical part) subjected to the ion bombardment process for one second at 1200 Torr.

Of FIGS. 4 to 9 showing the point analysis data, FIG. 4 shows point analysis data of a standard sample (spherical part of the electrode), FIG. 5 is a graph showing point analysis data of a sample (spherical part) not subjected to the ion bombardment process, FIG. 6 is a graph showing point analysis data of a sample (spherical part) that was subjected to the ion bombardment process for one second and at 400 Torr, FIG. 7 is a graph showing point analysis data of a sample (spherical part) that was subjected to the ion bombardment process for one second and at 800 Torr, FIG. 8 is a graph showing point analysis data of a sample (spherical part) that was subjected to the ion bombardment process for one second and at 1200 Torr, and FIG. 9 is a table showing the quantities of oxygen determined by the intensities of the analysis peaks of the test samples to the analysis peak of the standard sample.

As seen from FIGS. 4 to 9, the quantity of residual oxygen at the spherical part of the electrode is 0.74 wt % when the sample was not subjected to the ion bombardment process, and 0.06 wt % when the sample was subjected to the ion bombardment process for one second and at 1200 Torr. This value, 0.06 wt %, of the residual oxygen quantity is smaller than the value (0.17 wt %) when the sample was subjected to the ion bombardment process for one second and at 400 or 800 Torr. From this fact, it is seen that as the argon gas pressure is increased, the quantity of the residual oxygen is reduced, that is, the oxygen is effectively removed.

Figure 10:
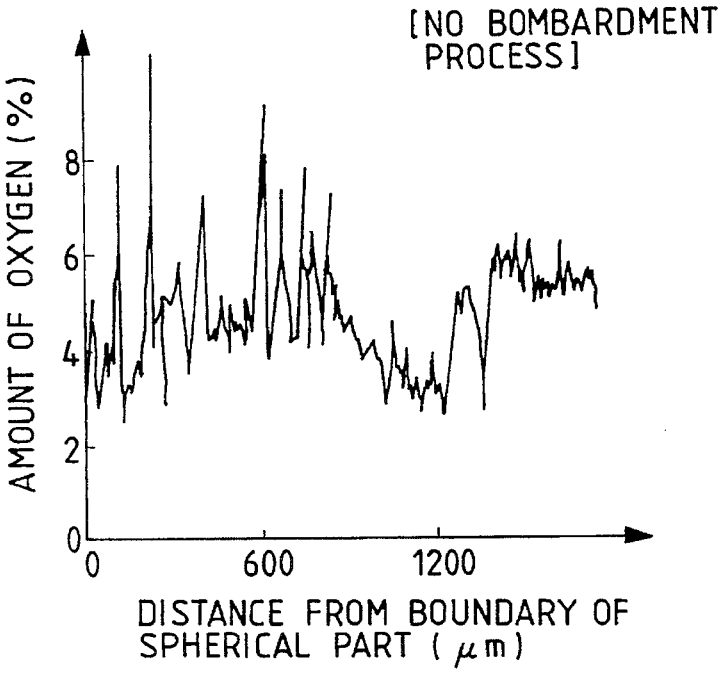
FIG. 10 is a graph showing line analysis data of a sample (shaft part of the electrode) not subjected to an ion bombardment process.
Figure 11:
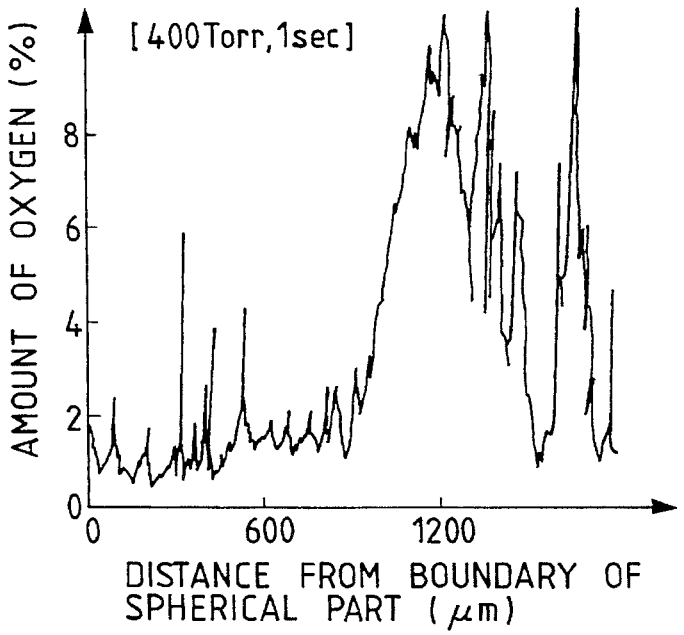
FIG. 11 is a graph showing line analysis data of a sample (electrode shaft part) subjected to an ion bombardment process for one second at 400 Torr.
Figure 12:
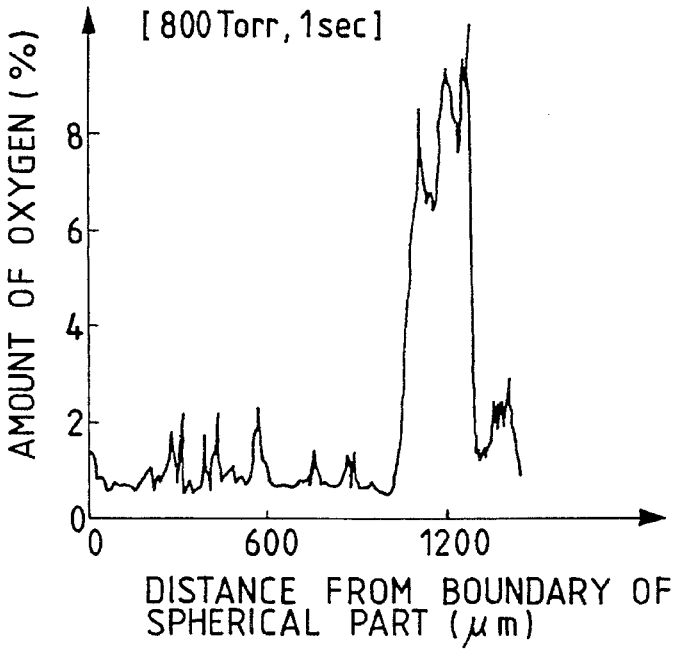
FIG. 12 is a graph showing line analysis data of a sample (electrode shaft part) subjected to an ion bombardment process for one second at 800 Torr.
Figure 13:
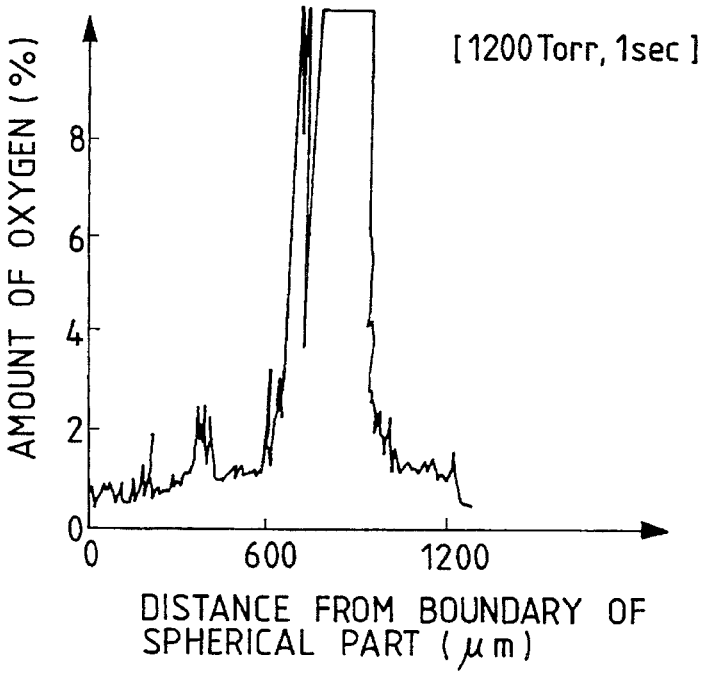
FIG. 13 is a graph showing line analysis data of a sample (electrode shaft part) subjected to an ion bombardment process for one second at 1200 Torr.

Of FIGS. 10 to 14 showing the line analysis data, FIG. 10 is a graph showing line analysis data of a sample (shaft part of the electrode) when it is not subjected to the ion bombardment process, FIG. 11 is a graph line showing analysis data of a sample (electrode shaft part) that was subjected to the ion bombardment process for one second and at 400 Torr, FIG. 12 is a graph showing line analysis data of a sample (electrode shaft part) that was subjected to the ion bombardment process for one second and at 800 Torr, FIG. 13 is a graph showing line analysis data of a sample (electrode shaft part) that was subjected to the ion bombardment process for one second and at 1200 Torr, and FIG. 14 is a table showing the quantities of oxygen determined by the intensities of the analysis peaks of the test samples to the intensity (plotted on the scale) of the analysis peak of the standard sample (measured every 150 μm from the boundary of the electrode shaft part and the spherical part).

The quantities of residual oxygen at the respective analysis positions are as tabulated in FIG. 14. As shown, under the conditions that the ion bombardment process was carried out (to cause an arc discharge) for one second and at 800 Torr and 200 Torr, the quantities of residual oxygen were 2.21 wt % and 3.08 wt % on the average along the spherical part of the electrode. These values of the residual oxygen quantities are smaller than the value 3.76 wt % of the residual oxygen quantity along the spherical part of the electrode under the conditions that the ion bombardment process was carried out (to cause an arc discharge) for one second and at 400 Torr. From this fact, it is seen that the residual oxygen along the spherical part of the electrode can effectively be removed when the argon gas pressure is 800 to 1200 Torr.

Figure 15A:
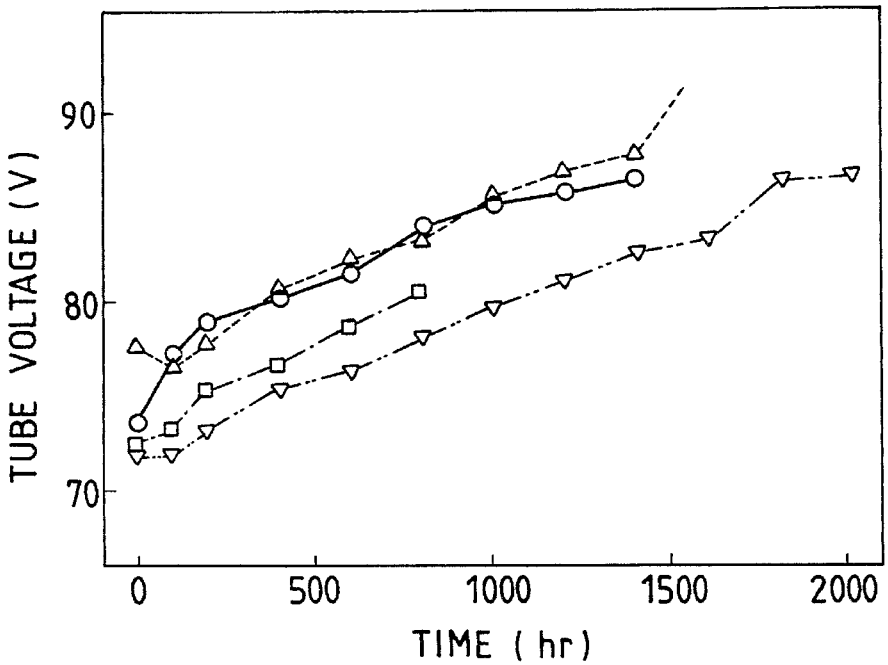
FIG. 15(*a*) is a graph showing tube voltage characteristics of tubes (subjected to an ion bombardment process by glow discharge) manufactured by a conventional method.
Figure 15B:
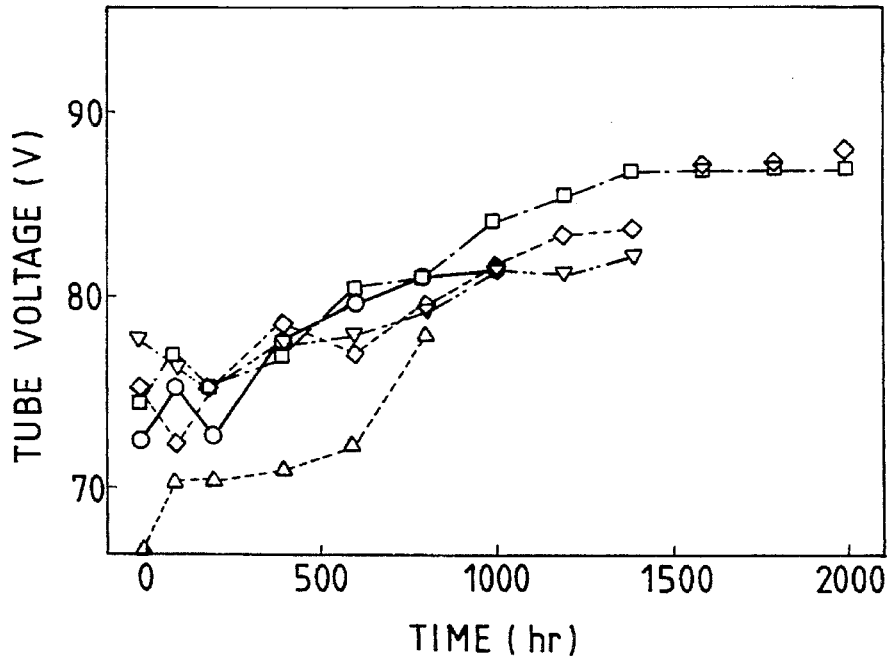

FIGS. 15(*a*) to 18(*b*) are graphs showing the results of life tests of two types of arc tubes.

The first type of arc tube was subjected to the ion bombardment process of the invention (the process conditions were 1000 Torr (argon gas pressure), 80 A/mm$^2$ (current density), and 1 second (discharge time)). The second type of arc tube was subjected to the conventional ion bombardment process (the process conditions were 400 Torr (argon gas pressure), several mA/mm$^2$ (current density), and 0.2 second (discharge time)).

In these figures, the (a) graph shows the results of the life test of arc tubes subjected to the conventional ion bombardment process, and the (b) graph shows the results of the life test of the arc tubes subjected to the ion bombardment process of the invention.

Figure 16A:
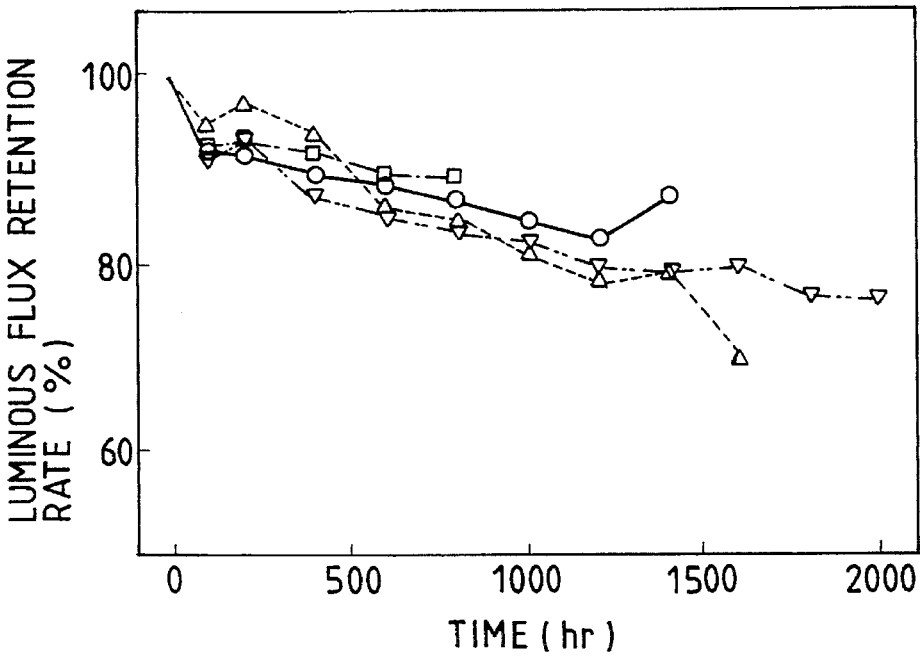
FIG. 16(*a*) is a graph showing luminous flux retention rate characteristics of arc tubes (subjected to an ion bombardment process by glow discharge) manufactured using the conventional method.
Figure 16B:
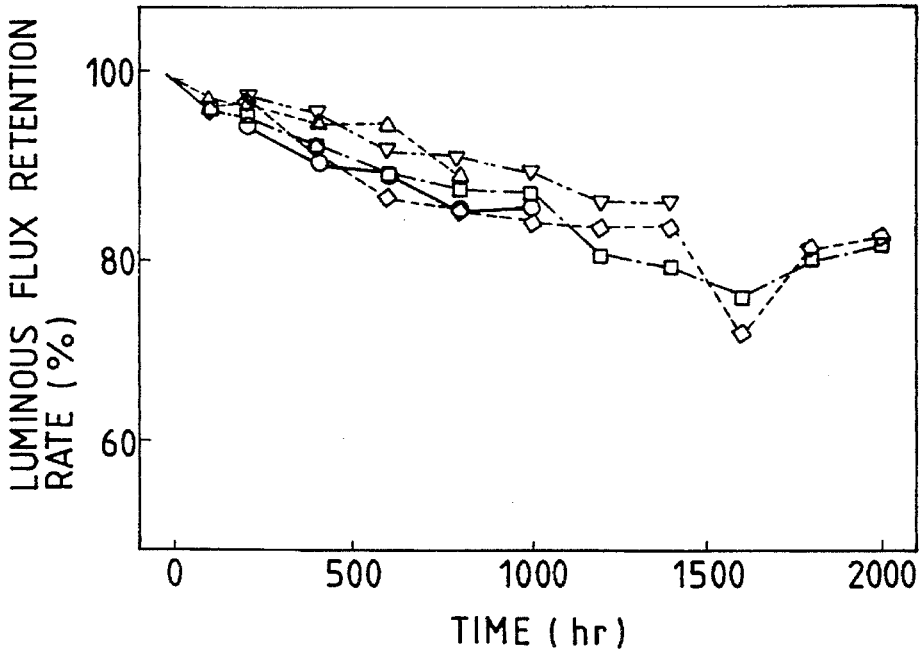
Figure 17A:
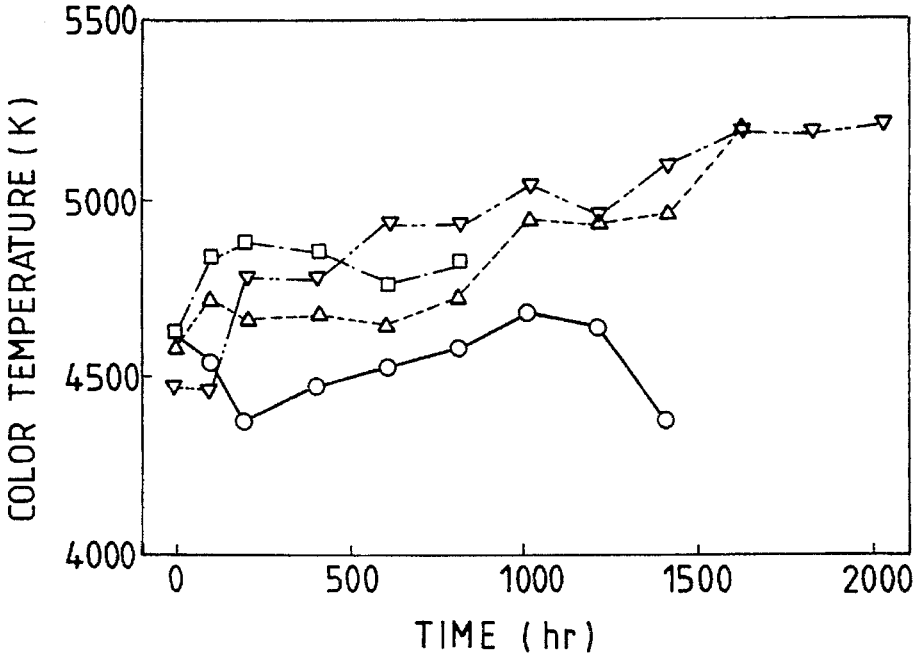
FIG. 17(*a*) is a graph showing color temperature characteristics of arc tubes (subjected to an ion bombardment process by glow discharge) manufactured using the conventional method.
Figure 17B:
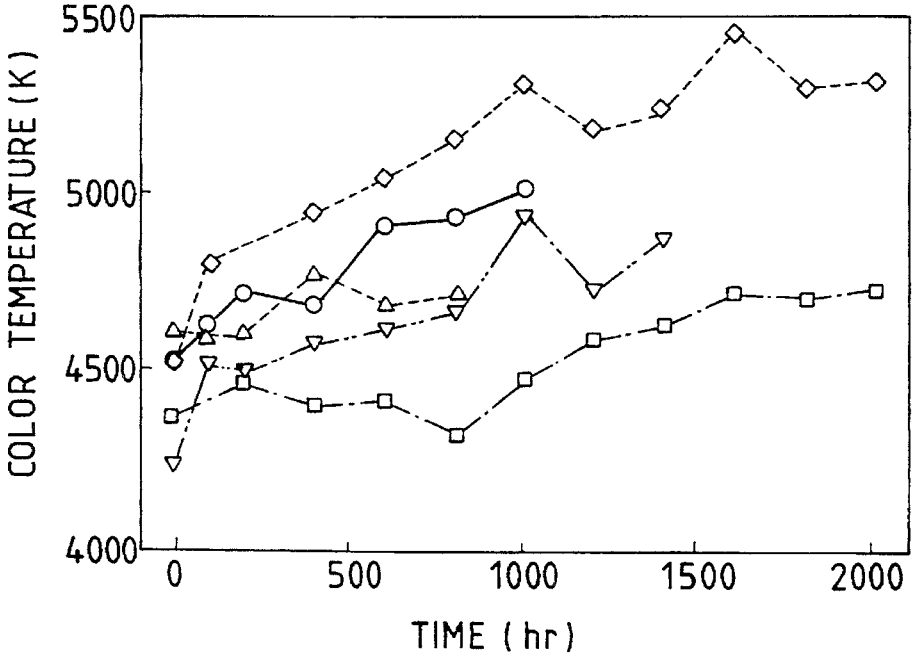
Figure 18A:
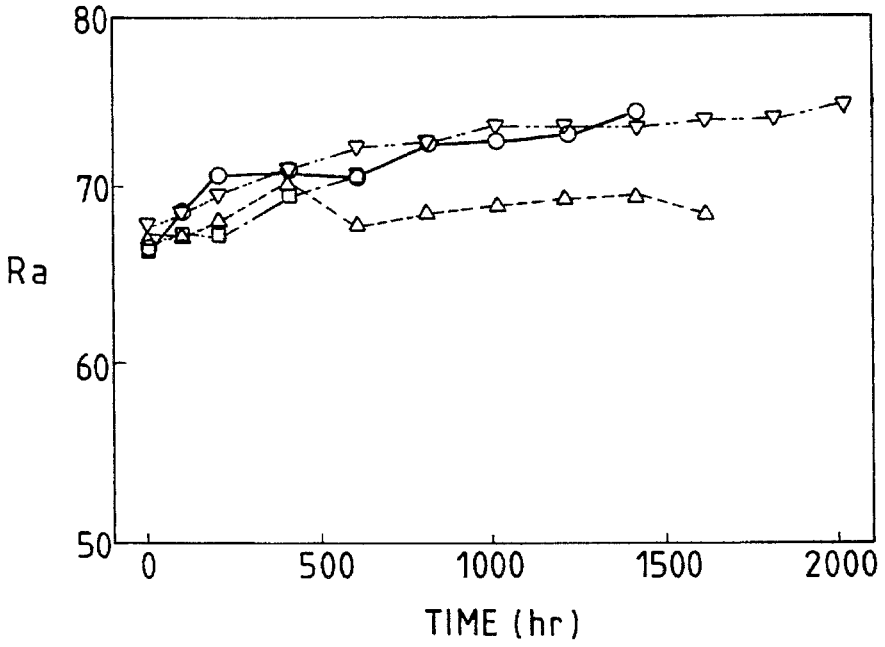
FIG. 18(*a*) is a graph showing color rendering index (Ra) characteristics of arc tubes (subjected to an ion bombardment process by glow discharge) manufactured using the conventional method.
Figure 18B:
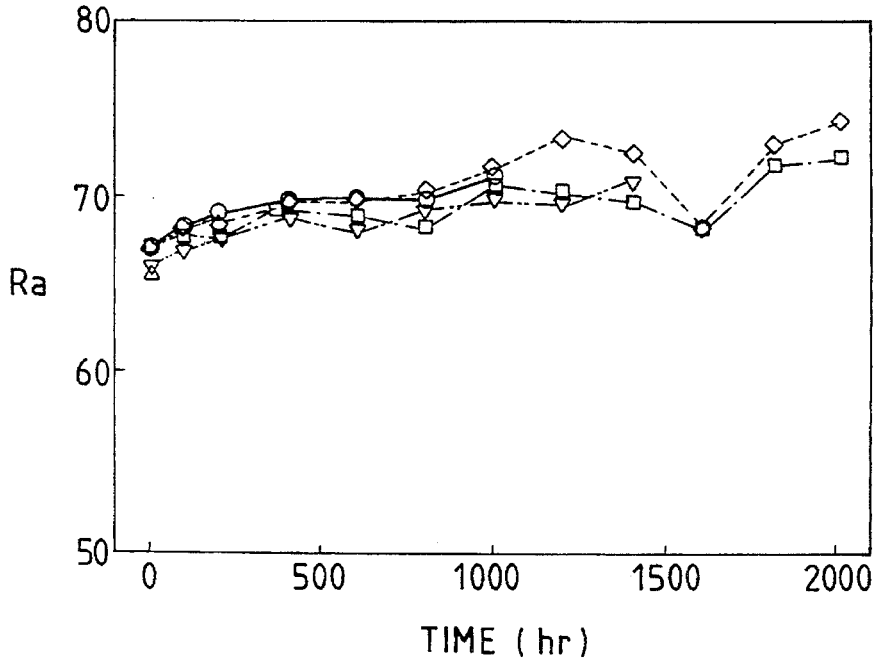

FIGS. 15(*a*) and 15(*b*) are graphs showing the electrical performance based on the tube voltage. FIGS. 16(*a*) and 16(*b*) are graphs showing the electrical performance based on the luminance-flux retention rate. FIGS. 17(*a*) and 17(*b*) are graphs showing the electrical performance based on the color temperature. FIGS. 18(*a*) and 18(*b*) are graphs showing the electrical performance based on Ra.

As seen from FIGS. 15(*a*) and 15(*b*), the tube voltage after 1000 hours varies by +9.9 V (112.8%) in the conventional test samples, while it varies by +8.8 V (109.5%) in the test samples of the invention. In other words, with the invention the tube voltage varies little from the value at the time the tube is turned on. In other words, although the samples of the present invention were subjected to the ion bombardment process where current of high current density is used, the tube voltage is little influenced by the high density current.

As seen from FIGS. 16(*a*) and 16(*b*), the luminous flux retention rate after 1000 hours varies by 83.0% in the conventional test samples, while it varies by 86.6% in the test samples of the invention. That is, the amount of change of the luminous flux retention rate of the samples of the invention is smaller than that of the conventional examples (the reduction of the luminous flux retention rate is small with the invention).

When the luminous flux value after 100 hours is set at 100%, the luminous flux retention rate after 1000 hours is 89.0% in the conventional examples, while it is 89.9% in the examples of the invention. These values of the luminous flux of the conventional and the inventive samples are little different from the luminous flux value after 100 hours. After 2000 hours, the luminous flux retention rate of the samples of the invention is 82.1%, which is higher than the 76.1% rate of the conventional samples after 2000 hours.

This fact implies that in the samples of the invention the reduction of the luminous flux retention rate near at a time point of 100 hours is smaller than that in the conventional samples, and subsequently the luminous flux retention rates of both samples vary at substantially equal reduction rates. It may considered that this arises from the fact that in the initial stage of the lifetime of the arc tube, when oxygen is present in the arc tube (glass tube), the following reaction takes place:

ti $4ScI_3+4SiO2_2+3O_2+6Hg \rightarrow 2Sc_2Si_20_7+6HgI_2$

By this reaction, $ScI_3$, which contributes to luminescence, disappears.

In the present invention, the amount of oxide left in the arc tube (glass tube) is small, a lesser amount of $ScI_3$ disappears by reaction, and no abrupt reduction of the luminous flux takes place in the initial stage of the tube lifetime.

As seen from FIGS. 17(*a*) and 17(*b*), the color temperature is +310K (107.2%) in the conventional samples, while it is +482K (111.8%) in the samples of the invention. The values of both samples are substantially equal to each other, and from this it is seen that the color temperature is also little influenced.

FIGS. 18(*a*) and 18(*b*) show that the color rendering index (Ra) is +4.7% (106.9%) in the conventional samples, while it is +4.2 (106.0%) in the samples of the invention. Those values are nearly equal and also show little influence.

The exhaust device is connected to the exhaust tube 2 of the arc tube by way of the discharge-tube connection head 10. Otherwise, the exhaust device may directly be connected to the exhaust tube 2, as described in Published Unexamined Japanese Patent Application No. Sho. 63-128519.

As seen from the foregoing description, in the method for manufacturing an arc tube for a discharge bulb according to the present invention, the current density of the current fed to the electrodes in the ion bombardment process is 30 to 100 A/mm$^2$. This value is considerably higher than the current density (several mA/mm$^2$ to several tens mA/mm$^2$) in the conventional ion bombardment process. Accordingly, an arc discharge, causing a high temperature, takes place between the electrodes. By the arc discharge, impurities (mainly oxide) is completely be removed from the electrode surfaces. The heating/degassing process, which follows the ion bombardment process, completely removes the impurities from the inner wall of the glass tube. The resultant arc tube has a good luminous flux retention rate.

The arc discharge time taking place between the electrodes is preferably within the range of 0.5 to 1 second. A discharge time of 0.5 second or longer provides effective removal of the oxide, while a discharge time of 1 second or shorter will not deform the electrodes. Accordingly, the arc tube of the invention is free from the problems attendant with poor removal of oxides from the electrode surfaces and deformation of the electrodes owing to overheating.

Moreover, argon gas, the inert gas used in the practice of the invention, is inexpensive and easy to handle. The ion bombardment process is carried out at a gas pressure within the range from 800 to 1200 Torr. This range of gas pressure is effective for removing oxides from the spherical parts of the electrodes and the spherical parts thereof. The resultant arc tube has a good luminous flux retention rate.

What is claimed is:

1. A method for manufacturing an arc tube for a discharge bulb, comprising the steps of:

disposing a pair of electrodes opposite one another in an arc tube;

connecting an exhaust tube to said arc tube;

exhausting gas from said arc tube through said exhaust tube;

introducing an inert gas into said arc tube through said exhaust tube;

connecting an arc discharge generating circuit to the oppositely disposed electrodes;

passing a current between said electrodes with said arc discharge generating circuit to carry out an ion bombardment process in which an arc discharge is caused between said electrodes in an inert gas atmosphere, a current density of a current applied to said electrodes by said arc discharge generating circuit during said ion bombardment process being in a range of 30 to 100 A/mm$^2$;

exhausting gas from said arc tube through said exhaust tube;

degassing said arc tube while heating said arc tube;

introducing a metal halide as a luminous material, mercury, and a rare gas into said arc tube through said exhaust tube; and tipping off said exhaust tube.

2. The arc tube manufacturing method according to claim 1, wherein a current application time of said current applied to said electrodes during said ion bombardment process is in a range of 0.5 to 1 second.

3. The arc tube manufacturing method according to claim 1, wherein said inert gas introduced into said arc tube is argon gas, and a gas pressure or said argon gas in said arc tube is in a range of 800 to 1200 Torr.

4. The arc tube manufacturing method according to claim 2, wherein said inert gas introduced into said arc tube is argon gas, and a gas pressure or said argon gas in said arc tube is in a range of 800 to 1200 Torr.

5. The arc tube manufacturing method according to claim 1, wherein said electrode is formed of tungsten.

* * * * *